US012281269B2

(12) United States Patent
Pickett et al.

(10) Patent No.: US 12,281,269 B2
(45) Date of Patent: Apr. 22, 2025

(54) HYBRID ETHYLENE CRACKING FURNACE

(71) Applicant: T.EN Process Technology, Inc., Houston, TX (US)

(72) Inventors: Thomas M. Pickett, Houston, TX (US); Yong Wang, Houston, TX (US); Chinh Dang, Houston, TX (US); William Larson, Houston, TX (US); John Murphey, III, Houston, TX (US); George Dabney, Jr., Houston, TX (US); Huynh Pham, Houston, TX (US); Astrid Han, Houston, TX (US)

(73) Assignee: T.EN PROCESS TECHNOLOGY, INC., Houston, TX (US)

( * ) Notice: Subject to any disclaimer, the term of this patent is extended or adjusted under 35 U.S.C. 154(b) by 0 days.

(21) Appl. No.: 17/071,999

(22) Filed: Oct. 15, 2020

(65) Prior Publication Data

US 2022/0119716 A1 Apr. 21, 2022

(51) Int. Cl.
*C10G 9/20* (2006.01)
*F28F 1/10* (2006.01)

(52) U.S. Cl.
CPC ..... *C10G 9/20* (2013.01); *F28F 1/10* (2013.01); *C10G 2300/1059* (2013.01); *C10G 2300/1074* (2013.01); *C10G 2400/20* (2013.01)

(58) Field of Classification Search
CPC ..... C10G 9/20; C10G 2300/1059; C10G 2300/1074; C10G 2400/20
See application file for complete search history.

(56) References Cited

U.S. PATENT DOCUMENTS 3,407,789 A * 10/1968 Hallee ..... C10G 9/20 48/214 R
3,487,121 A * 12/1969 Hallee ..... C07C 5/327 585/652
4,329,150 A * 5/1982 Drinkard ..... C10G 9/206 422/62
4,457,364 A * 7/1984 DiNicolantonio ..... C10G 9/002 48/190
4,479,869 A * 10/1984 Petterson ..... C10G 9/36 208/132

(Continued)

FOREIGN PATENT DOCUMENTS

EP 2949728 A1 12/2015

OTHER PUBLICATIONS

PCT International Search Report and Written Opinion, dated Feb. 28, 2022, issued during the prosecution of PCT International Patent Application No. PCT/US2021/054200, 14 pages.

*Primary Examiner* — Michelle Stein
(74) *Attorney, Agent, or Firm* — Troutman Pepper Locke LLP; Gabrielle L. Gelozin

(57) ABSTRACT

A cracking furnace for cracking a hydrocarbon feed, the furnace including a firebox having a single radiant zone including, a first plurality of cracking coils each having a first shape arranged within the firebox. The radiant zone includes a second plurality of cracking coils each having a second shape arranged within the radiant zone. A burner section positioned below the first plurality cracking coils and below the second plurality of cracking coils. A convection section is positioned on top of the firebox configured to recover residual heat from the firebox.

12 Claims, 3 Drawing Sheets

(56) References Cited

U.S. PATENT DOCUMENTS

| | | | | |
|---|---|---|---|---|
| 4,552,644 | A * | 11/1985 | Johnson | C10G 9/14 208/130 |
| 5,147,511 | A * | 9/1992 | Woebcke | C10G 9/20 196/110 |
| 5,151,158 | A * | 9/1992 | Bowen | C10G 9/20 196/110 |
| 5,394,837 | A | 3/1995 | Tsai et al. | |
| 2004/0147794 | A1* | 7/2004 | Brown | C07C 4/04 585/650 |
| 2005/0019233 | A1* | 1/2005 | Brewer | C10G 9/20 422/198 |
| 2006/0102327 | A1* | 5/2006 | Inui | C10G 9/20 165/133 |
| 2008/0017550 | A1* | 1/2008 | Caro | C10G 9/18 208/132 |
| 2008/0029434 | A1* | 2/2008 | Brewer | C10G 9/20 208/132 |
| 2008/0142411 | A1* | 6/2008 | Barendregt | C10G 9/20 208/132 |
| 2009/0020459 | A1* | 1/2009 | De Haan | C10G 9/16 208/48 R |
| 2009/0022635 | A1* | 1/2009 | Zhao | C10G 9/18 422/198 |
| 2009/0054716 | A1* | 2/2009 | Baumgartner | C10G 9/20 585/648 |
| 2012/0219466 | A1* | 8/2012 | He | C07C 4/04 422/198 |
| 2014/0257001 | A1* | 9/2014 | Spicer | C10G 9/20 585/300 |
| 2015/0240168 | A1 | 8/2015 | Crowe et al. | |
| 2020/0072503 | A1 | 3/2020 | Shah et al. | |

* cited by examiner

HYBRID ETHYLENE CRACKING FURNACE

BACKGROUND

Technological Field

The present disclosure relates to ethylene cracking furnace systems, and more particularly to an ethylene cracking furnace configured to process multiple hydrocarbon feeds having differing properties at the same time.

Description of Related Art

The petrochemical industry has long used hydrocarbon feedstocks for the production of valuable olefinic materials, such as ethylene and propylene. Ideally, commercial operations have been carried out using normally gaseous hydrocarbons such as ethane and propane as the feedstock. As the lighter hydrocarbons have been consumed and the availability of the lighter hydrocarbons has decreased, the industry has more recently been required to crack heavier hydrocarbons, such as naphthas and gas oils.

A typical process for the production of olefins from hydrocarbon feedstocks is the thermal cracking process. In this process, hydrocarbons undergo cracking at elevated temperatures to produce hydrocarbons containing from 1 to 4 carbon atoms, especially the corresponding olefins. Typically, the hydrocarbon to be cracked is delivered to a furnace comprised of both a convection and radiant heating zone. Cracking furnaces are the heart of an ethylene plant. In these furnaces, feeds containing one or more hydrocarbon types are converted into a cracked product gas by cracking of hydrocarbons. The hydrocarbon is initially preheated in the convection zone to a temperature below that at which significant reaction is initiated; and thereafter is delivered to the radiant zone where it is subjected to intense heat from radiant burners. Examples of conventional furnaces and processes are shown in U.S. Pat. No. 3,487,121 (Hallee), and U.S. Pat. No. 5,147,511 (Woebcke).

In cracking furnaces, the reactor tubes may be arranged vertically in one or more passes. In the art, the term cracking coil is also used. One or more of the cracking coils may be present to form the total radiant reactor section of a firebox. Conventionally, ethylene cracking tubes are arranged in the firebox in one lane wherein the lane is heated from both sides by burners.

Radiant coils are designed to crack different hydrocarbon feedstocks to produce ethylene, propylene and other petrochemical products. Thus, liquid feed furnaces and vapor feed furnaces are developed to crack liquid feed and vapor feed, respectively. In the liquid feed ethylene plant, liquid feed is the major feedstock which is processed in liquid feed furnace, namely fresh feed furnaces. Plant produced ethane and propane are also good ethylene making vapor feedstocks which are typically recycled to vapor feed furnaces, namely recycle feed furnaces, to crack to extinction. The furnace island of a liquid feed ethylene plant is composed of multiple fresh feed and recycle feed furnaces. Recently the industry has experienced aggressive plant revamps requiring as much as 50% capacity increase. Although adding fresh feed furnaces to handle more liquid feedstock can be done, revamping the existing recycle furnace or adding a recycle furnace is not always economical. The existing furnaces have been in operation for more than 10-15 years. It takes long turnaround time and major effort to revamp the furnace and there are a lot of uncertainties of the performance. Again, building a new furnace may be not economic or limited by plot space. Thus, there is a need in the art for a furnace which is able to provide cracking flexibility for a variety of hydrocarbon feedstocks. There also remains a need in the art for such furnace and components that are economically viable. The present disclosure may provide a solution for at least one of these remaining challenges.

SUMMARY OF THE INVENTION

A cracking furnace for cracking hydrocarbon feeds is disclosed. The cracking furnace includes a firebox, a first plurality of cracking coils each having a first shape arranged within the firebox, a second plurality of cracking coils each having a second shape arranged within the firebox, and a burner section positioned below the first plurality cracking coils and below the second plurality of cracking coils, and a convection section positioned on top of the firebox configured to recover residual heat from the firebox. Each of the coils of the first plurality of cracking coils can be two leg U-shaped coils. It is also considered that, each of the coils of the second plurality of cracking coils can be six leg serpentine M-shaped coils or four leg serpentine W-shaped coils. It is also considered that, each of the first plurality of coils can define a first coil inlet and a first coil outlet with a first flow path defined therebetween, and wherein each of the second plurality of coils defines a second coil inlet and a second coil outlet with a second flow path defined therebetween. The hybrid radiant coil concept can be expanded to multiple firebox application with different combinations. One example can be the first plurality of cracking coils installed in one firebox and the second plurality of cracking coils installed in the other firebox. Another example can be one firebox contains the first plurality of cracking coils and the other firebox contains the first plurality of cracking coils and the second plurality of cracking coils in different radiant zones.

It is also considered that, the burner section can include a first plurality of burners and a second plurality of burners. The first plurality of burners can be grouped under the first plurality of cracking coils. The second plurality of burners can be grouped under the second plurality of cracking coils.

A method for cracking a hybrid hydrocarbon feed is also disclosed. The method includes feeding a first hydrocarbon feedstock into a firebox, feeding a second hydrocarbon feedstock into the firebox while feeding the first hydrocarbon feedstock to the firebox, heating each of the feedstocks within a radiant section of the firebox to convert each of the hydrocarbon feedstocks to a unique thermally cracked product, collecting the thermally cracked products from the radiant section, cooling the thermally cracked products, and recovering ethylene, propylene and other high value chemicals from the thermally cracked products.

It is also considered that, a firebox temperature for each of the feedstocks can be the same within the firebox. The firebox temperature can be dependent on outlet temperature of the first hydrocarbon feedstock. An outlet temperature of the second hydrocarbon feedstock can be dependent on a feed rate of the second hydrocarbon feed. It is also considered that, the first hydrocarbon feedstock can be a liquid, such as a vacuum gas oil or naphtha. The second hydrocarbon feedstock can be a vapor, such as be butane, propane, or ethane. It is also considered that, ethylene and propylene can be recovered from the cracked product. The first hydrocarbon feedstock can follow a first path within the firebox, and the second hydrocarbon feedstock can follow a second path within the firebox, wherein the first path is defined through a plurality of U-shaped cracking coils, and wherein the second path is defined through a plurality of M-shaped cracking coils or W-shaped cracking coils. It is also considered that, the first path can be shorter than the second path. The method can also include pre-heating the first hydrocarbon feedstock and the second hydrocarbon feedstock with residual heat from the firebox within a convection section.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION

Figure 1:
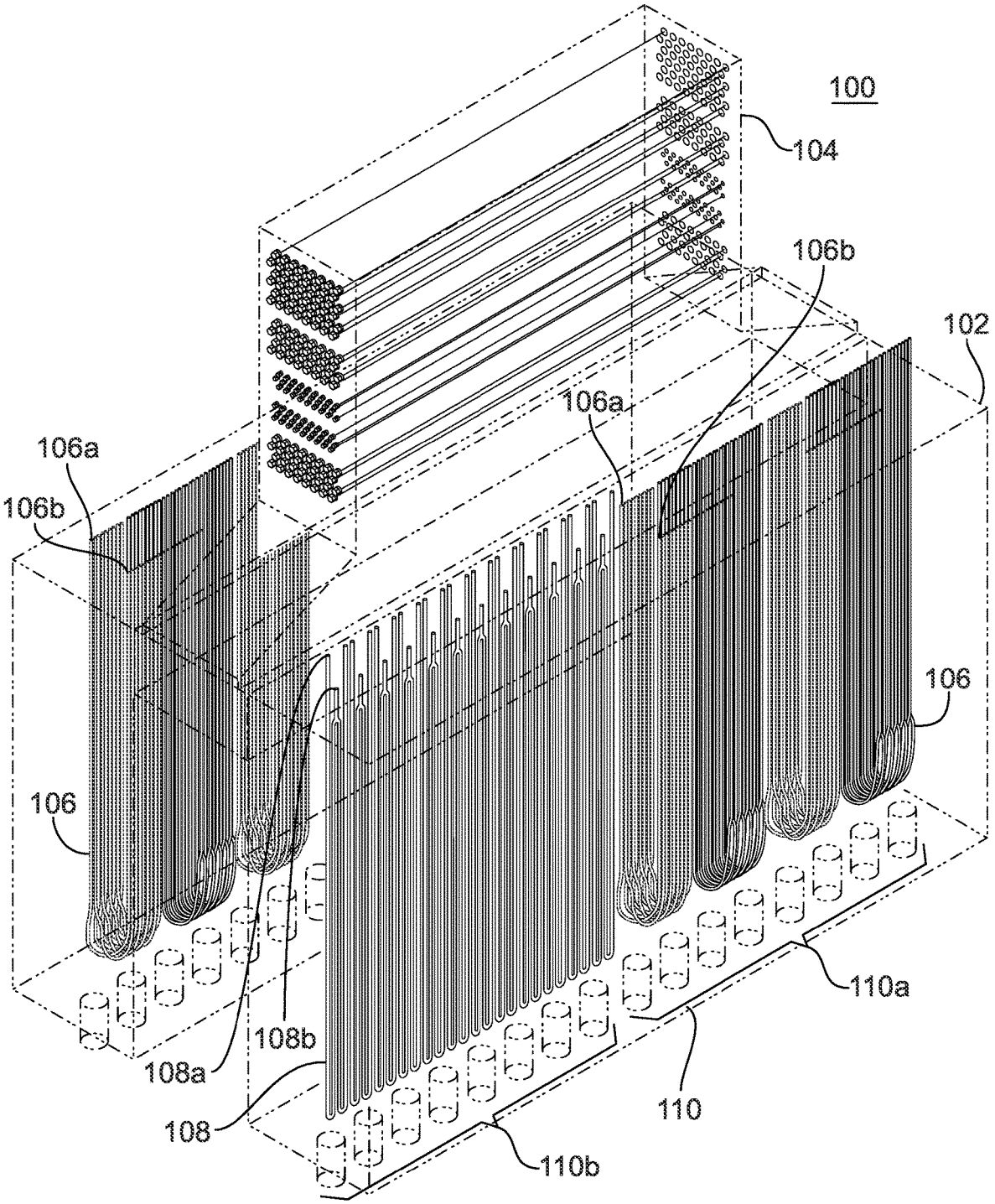
FIG. 1 is a perspective view of a cracking furnace according to the disclosure.
Figure 2:
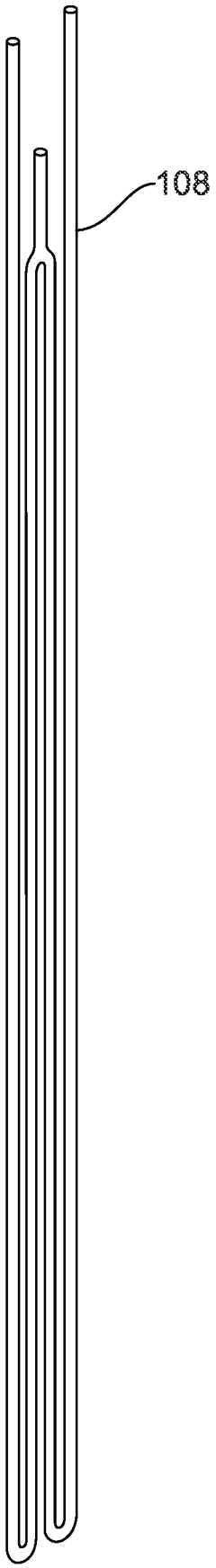
FIG. 2 is a perspective view of an W-shaped coil of the cracking furnace of FIG. 1.
Figure 3:
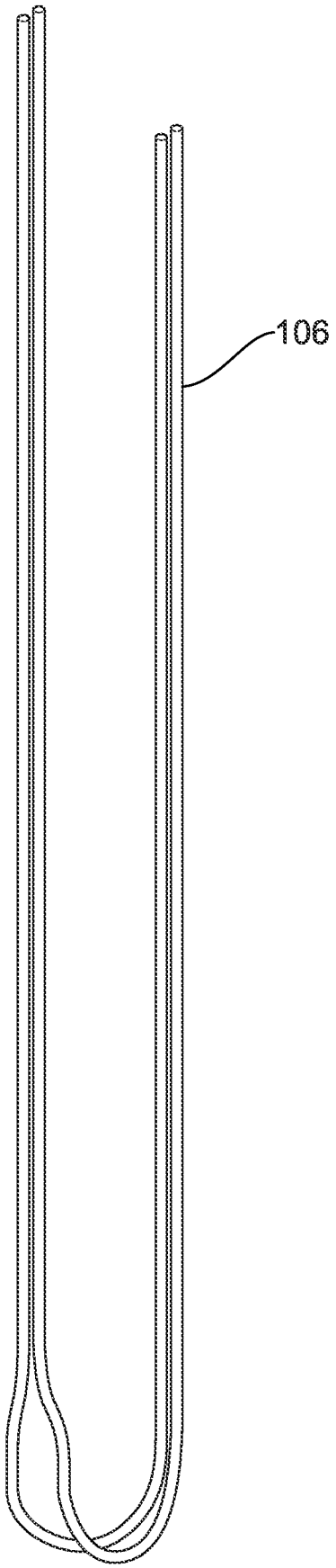
FIG. 3 is a perspective view of u U-shaped coil of the cracking furnace of FIG. 1.

Reference will now be made to the drawings wherein like reference numerals identify similar structural features or aspects of the subject invention. For purposes of explanation and illustration, and not limitation, a partial view of an exemplary embodiment of a cracking furnace in accordance with the invention is shown in FIG. 1 and is designated generally by reference character 100. Other embodiments of the cracking furnace in accordance with the disclosure, or aspects thereof, are provided in FIGS. 2-3, as will be described. The methods and systems of the invention can be used to process multiple types of feedstocks simultaneously.

FIG. 1 shows a cracking furnace 100 for cracking various hydrocarbon feedstocks to produce ethylene, propylene and other petrochemical products. The furnace includes a firebox 102 configured to simultaneously accept various hydrocarbon feeds. The hydrocarbon feeds differ in chemical make-up and physical state. The cracking furnace 100 also includes a convection section 104 positioned on top of the firebox 102. The convection section 104 above the firebox 102 is positioned in order to recover residual heat from the firebox and preheat the hydrocarbon feeds coming into the firebox 102.

The firebox 102 includes first plurality of cracking coils 106. Each of the cracking coils 106 of the first plurality can be configured to accept a liquid feedstock. Each of the cracking coils of the first plurality 106 have a U-shape. Each of the first plurality of coils 106 defines a first coil 106*a* inlet and a first coil outlet 106*b* with a first flow path defined therebetween. An inlet leg of the U coils can include the 25Cr35Ni alloy and the outlet leg of U coils can include the 35Cr 45Ni alloy. The cracking coils of the first plurality 106 are grouped together. There are a variety of feedstocks that can be utilized in this process, including a heavy liquid feed, such as vacuum gas oil or a light liquid feed, such as naphtha.

The furnace can be a hybrid product of an ethylene plant revamp. The furnace can be primarily designed to process fresh liquid feed in the first plurality of cracking coils. M or W shaped coils from a recycle furnace are added, and provide the ability to process gas feeds. Thus, the firebox 102 further includes a second plurality of cracking coils 108. Each of the cracking coils 108 of the second plurality are configured to accept a vapor hydrocarbon feedstock, such as butane, propane and ethane. Each of the second plurality of coils 108 defines a second coil inlet 108*a* and a second coil outlet 108*b* with a second flow path defined therebetween, Each of the cracking coils of the second plurality 108 have either an M-shape or a W-shape. An inlet leg of the M or W coils can include the 25Cr35Ni alloy and the outlet leg of W coils and of M coils can include the 35Cr 45Ni alloy. The cracking coils of the second plurality 108 are grouped together separately from the first plurality of cracking coils 106. Cracking coils 108 can have larger diameters than cracking coils 106. Further shown in FIG. 1, a burner section 110 is positioned below the cracking coils 106/108. The burner section 110 includes a first plurality of burners 110*a* and a second plurality of burners 110*b*, wherein the first plurality of burners 110*a* are grouped under the first plurality of cracking coils 106 and the second plurality of burners 110*b* are grouped under the second plurality of cracking coils 108. Typically individual burner firing duty is the same for all burners in a firebox. Different groups of burners firing rate depends on the quantity of burners in the group. In the present configuration, one firebox burner firing only has one set of fuel gas flow control valve. Hydrocarbon feed cracking severity in the firebox is controlled by its coil outlet temperature. When two types of feeds are cracked in the same firebox, to control cracking severity of the feedstocks, one feed is selected as the primary feed. The primary feed coil outlet temperature sets the individual burner firing duty. The other feed, the secondary feed, in the same firebox has the same individual burner firing duty. The secondary feed cracking severity, coil outlet temperature, has to be adjusted by the feed rate. Higher feed rate will give lower coil outlet temperature and vice versa. On the other hand, fuel gas flow rate control can be divided into different groups (zones) in the same firebox for different feeds. Then the individual burner firing rate can be different. Based on the need of different feed cracking severity, coil outlet temperature, different individual burner firing rates can be set for different groups, and then there is no need to adjust feed rate. The additional operation freedom comes from more fuel gas flow rate control valves for one firebox. However, the first approach, single fuel gas control per firebox, is the preferred typical arrangement.

The cracking furnace 100 described above is used to crack a hydrocarbon feed by feeding a first hydrocarbon feedstock into the firebox 102, feeding a second hydrocarbon feedstock into the firebox 102 while feeding the first hydrocarbon feedstock to the firebox 102, heating each of the feedstocks within a radiant section 102*a* of the firebox to convert each of the hydrocarbon feedstocks to a unique thermally cracked product, such as ethylene and propylene. The firing duty of the individual burner can be the same within the firebox 102. The heating temperature for both of the feedstocks is based on the outlet temperature of the first hydrocarbon feedstock. The outlet temperature of the second hydrocarbon feedstock is controlled by a feed rate of the second hydrocarbon feed. Even though both hydrocarbon feeds are cracked in the same firebox, coil outlet temperature of the primary feed can be used to control burner firing duty and the feed rate of the secondary feed can be used to control the coil outlet temperature of the secondary feed. Thus, the target cracking severity levels of both feedstocks can be achieved.

The method includes collecting the thermally cracked products from the radiant section, cooling the thermally cracked products, recovering the at least two unique olefins from the thermally cracked products. The cracking effluents needs to be quenched rapidly to preserve the olefin yields after leaving the firebox 102. The heat recovered from the cracking effluent is used to preheat hydrocarbon feed and dilution steam and generate high-pressure steam within the convection section 104. The ability to process different feedstock greatly increases operation flexibility in cracking processes. Aspects of the disclosure are also beneficial in plant revamp situations.

The methods and systems of the present disclosure, as described above and shown in the drawings, provide for a hybrid coil ethylene cracking furnace with superior properties including increased reliability and adaptability. While the apparatus and methods of the subject disclosure have been showing and described with reference to embodiments, those skilled in the art will readily appreciate that changes and/or modifications may be made thereto without departing from the spirit and score of the subject disclosure.

What is claimed is:

1. A method for cracking at least two hydrocarbon feeds comprising:

feeding a first hydrocarbon feedstock into a single radiant zone of a firebox, wherein the first hydrocarbon feedstock follows a first path within the firebox defined through a plurality of U-shaped cracking coils;

feeding a second hydrocarbon feedstock into the firebox while feeding the first hydrocarbon feedstock to the single radiant zone, wherein the second hydrocarbon feedstock follows a second path within the firebox defined through a plurality of M-shaped cracking coils or W-shaped cracking coils, wherein the plurality of M-shaped cracking coils or W-shaped cracking coils are separate from the plurality of U-shaped cracking coils within the single radiant zone, wherein the cracking coils of the second hydrocarbon feedstock having a diameter greater than those of the first hydrocarbon feedstock;

heating each of the feedstocks within the single radiant zone of the firebox to convert each of the hydrocarbon feedstocks to a unique thermally cracked product;

collecting the thermally cracked products from the single radiant zone;

cooling the thermally cracked products; and recovering at least two olefins from the thermally cracked products, wherein a heating temperature in the single radiant zone of the firebox for each of the first and second feedstocks is dependent on outlet temperature of the first hydrocarbon feedstock.

2. The method of claim 1, wherein a firebox temperature for each of the feedstocks is the same within the firebox.

3. The method of claim 1, wherein an outlet temperature of the second hydrocarbon feedstock is dependent on a feed rate of the second hydrocarbon feed.

4. The method of claim 1, wherein the first hydrocarbon feedstock is a liquid.

5. The method of claim 4, wherein the first hydrocarbon feedstock is vacuum gas oil or naphtha.

6. The method of claim 1, wherein the second hydrocarbon feedstock is a vapor.

7. The method of claim 6, wherein the second hydrocarbon feedstock is butane, propane or ethane.

8. The method of claim 1, wherein ethylene and propylene are recovered.

9. The method of claim 1, wherein the first path is shorter than the second path.

10. The method of claim 1, further comprising pre-heating the first hydrocarbon feedstock and the second hydrocarbon feedstock with residual heat from the firebox within a convection section.

11. The method of claim 1, further comprising removing a plurality of cracking coils from a second firebox and coupling the plurality of coils within the firebox in order to feed the second hydrocarbon feedstock through.

12. A method of overhauling a cracking furnace comprising:

operating a liquid feed furnace, the furnace including a first plurality of U-shaped cracking coils in a single radiant zone of a firebox; and installing a second plurality of M- or W-shaped cracking coils in the single radiant zone of the firebox but separate from the first plurality of U-shaped cracking coils, wherein a heating temperature in the radiant zone of the firebox for the first plurality and the second plurality of cracking coils is dependent on a coil outlet temperature of a first hydrocarbon feedstock of the first plurality of cracking coils and wherein the cracking coils of the second hydrocarbon feedstock having a diameter greater than those of the first hydrocarbon feedstock.

* * * * *